US007229070B2

(12) United States Patent
Nakano

(10) Patent No.: US 7,229,070 B2
(45) Date of Patent: Jun. 12, 2007

(54) ROTARY CLUTCH DEVICE AND SHEET FEEDER USING THE SAME

(75) Inventor: Hiroshi Nakano, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 197 days.

(21) Appl. No.: 10/664,899

(22) Filed: Sep. 22, 2003

(65) Prior Publication Data

US 2004/0061278 A1 Apr. 1, 2004

(30) Foreign Application Priority Data

Sep. 30, 2002 (JP) ..... 2002-286057

(51) Int. Cl.
*B65H 3/06* (2006.01)

(52) U.S. Cl. ..... 271/10.13; 271/10.05; 271/114

(58) Field of Classification Search ..... 271/10.05, 271/10.13, 114; 192/71, 79, 46, 207, 212
See application file for complete search history.

(56) References Cited

U.S. PATENT DOCUMENTS 4,529,188 A * 7/1985 Sturnick ..... 271/10.12
4,909,498 A * 3/1990 Rutishauser ..... 271/10.04
5,860,645 A * 1/1999 Tomura et al. ..... 271/10.13
5,961,112 A * 10/1999 Kim ..... 271/10.05
6,070,867 A * 6/2000 Tsurumi et al. ..... 271/114
6,899,326 B2 * 5/2005 Kawakami et al. ..... 271/114

FOREIGN PATENT DOCUMENTS

JP A 11-190410 7/1999

* cited by examiner

*Primary Examiner*—Patrick Mackey
*Assistant Examiner*—Kaitlin Joerger
(74) *Attorney, Agent, or Firm*—Oliff & Berridge, PLC

(57) ABSTRACT

A rotary clutch device includes: a tooth-partially-lacking gear that can mesh with a drive gear and is given initial rotation force; a rotatable cam body that is concentric with the tooth-partially-lacking gear, having an engagement step; and an elastic body. An engagement lever is engaged with and disengaged from the engagement step according to an intermittent operation of an actuator so that the tooth-partially-lacking gear starts and stops to rotate. Rotation force of the tooth-partially-lacking gear is transmitted to the cam body via the elastic body.

8 Claims, 6 Drawing Sheets

ROTARY CLUTCH DEVICE AND SHEET FEEDER USING THE SAME

BACKGROUND OF THE INVENTION

1. Field of the Invention

The present invention relates to a rotary clutch device and a sheet feeder using the same. The present invention also relates to an image forming apparatus such as a laser printer, a copier, or a facsimile machine.

2. Background Art

A rotary clutch device provided in a sheet feeder of a laser printer is known in which a cam body having an engagement step on its outer circumferential surface is formed integrally with a tooth-partially-lacking gear that is linked to a D-shaped sheet feed roller. An engagement lever is provided so as to be engageable with and disengageable from the engagement step. When the mesh between the tooth-partially-lacking gear and a drive gear is canceled, the engagement lever engages the engagement step, whereby the tooth-partially-lacking gear and the sheet feed roller are stopped (e.g., JP-A-11-190410).

The engagement lever is operated intermittently with prescribed timing by an actuator such as a solenoid. An urging spring for imparting initial rotation force to the tooth-partially-lacking gear to cause the tooth-partially-lacking gear to mesh with the gear portion of the drive gear when an engagement nail located at the tip of the engagement lever is disengaged from the engagement step is connected to the tooth-partially-lacking gear. Therefore, immediately after the disengagement of the engagement lever from the engagement step, the cam body that is integral with the tooth-partially-lacking gear is rotated by the urging spring. The engagement lever is then returned to the original position due to the intermittent operation of the solenoid and hence the engagement nail of the engagement lever touches the outer circumferential surface of the cam body. At this time, an impact sound (a click) that occurs when the engagement nail of the engagement lever collides with the outer circumferential surface of the cam body.

In the technique disclosed in JP-A-11-190410, to reduce the impact sound, a cam release surface is formed, as part of the outer circumferential surface of the cam body, upstream of the engagement step in the rotation direction and a cam recovery surface is formed upstream of and adjacent to the cam release surface in such a manner that the radius (i.e., height) of the cam recovery surface is set laser than that of the cam release surface.

In the technique disclosed in JP-A-11-190410, by virtue of the above structure, the impact sound that occurs when the engagement nail touches the outer circumferential surface of the cam body approximately perpendicularly. However, the impact sound (a click) that occurs when the engagement nail of the engagement lever engages with the engagement step of the cam body that is given initial rotation force by the urging spring after the non-tooth portion of the tooth-partially-lacking gear is opposed to the drive gear and hence the mesh between the tooth-partially-lacking gear and the drive gear is canceled cannot be eliminated.

SUMMARY OF THE INVENTION

An object of the present invention is to solve the above problem and thereby provide a rotary clutch device in which the impact sound that occurs between the engagement lever and the cam body at a stop phase of the cam body is reduced, as well as a silent sheet feeder and an image forming apparatus using such a rotary clutch device.

To achieve the object, the invention provides a rotary clutch device, including: a tooth-partially-lacking gear that can mesh with a drive gear and is given initial rotation force; a rotatable cam body that is concentric with the tooth-partially-lacking gear, having an engagement step; and an elastic body. An engagement lever is engaged with and disengaged from the engagement step according to an intermittent operation of an actuator so that the tooth-partially-lacking gear starts and stops to rotate. Rotation force of the tooth-partially-lacking gear is transmitted to the cam body via the elastic body.

The invention may provide a sheet feeder, including: a sheet stacking unit in which sheets are stacked; a sheet feed roller that sends out a sheet supplied from the sheet stacking unit; and the rotary clutch device. The sheet feed roller is driven by a drive gear via the rotary clutch device.

The invention may provide an image forming apparatus, including: a sheet stacking unit in which sheets are stacked; a sheet feed roller that sends out a sheet supplied from the sheet stacking unit; an image forming unit that forms an image on a sheet that is sent by the sheet feed roller; and the rotary clutch device. The sheet feed roller is driven by a drive gear via the rotary clutch device.

The invention may provide a rotary clutch device, including: a first rotating body with which a rotating force is supplied by a driving source; a second rotating body disposed concentrically with the first rotating body, the second rotating body with which the rotating force is supplied by the first rotating body; an engagement portion being engageable with the second rotating body to restrict rotation thereof; and an elastic body disposed between the first rotating body and the second rotating body to transmit the rotating force from the first rotating body to the second rotating body. The elastic body is compressed when the engagement portion restricts the rotation of the second rotating body.

The invention may provide a rotary clutch device, including: a first rotating body disposed rotatably around an rotating axis, the first rotating body having a first opposing surface being perpendicular to the rotating axis; a second rotating body disposed concentrically with the first rotating body, the second rotating body having a second opposing surface opposed to the first opposing surface and being perpendicular to the rotating axis; a restriction portion capable of restricting rotation of the second rotating body in a predetermined direction; and an elastic body. The first rotating surface includes a first support portion projecting towards the second rotating body. The second rotating surface includes a second support portion projecting towards the first rotating body and being positioned in the predetermined direction from the first support portion. The elastic body is arranged between the first support portion and the second support portion.

The invention may provide a rotary clutch device, including: a first rotating body with which a rotating force is supplied from a driving source; a second rotating body with which the rotating force is supplied by the first rotating body; an engagement portion being engageable with the second rotating body to restrict rotation thereof periodically; and an impact absorber disposed between the first rotating body and the second rotating body to absorb an impact that occurs when the engagement portion is engaged with the second rotating body.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
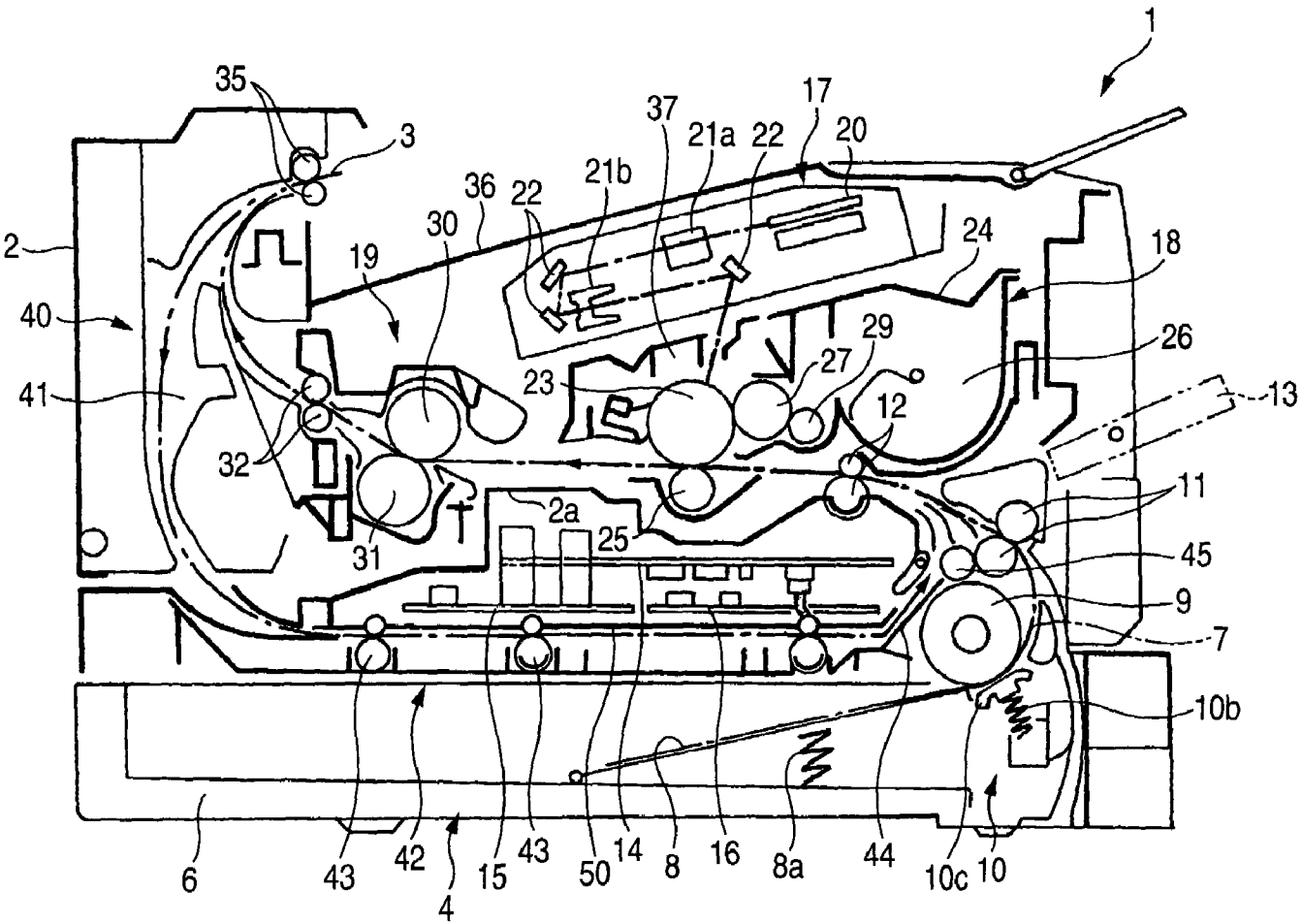
FIG. 1 is a schematic sectional view of a laser printer as an image forming apparatus according to an embodiment of the present invention.
Figure 2:
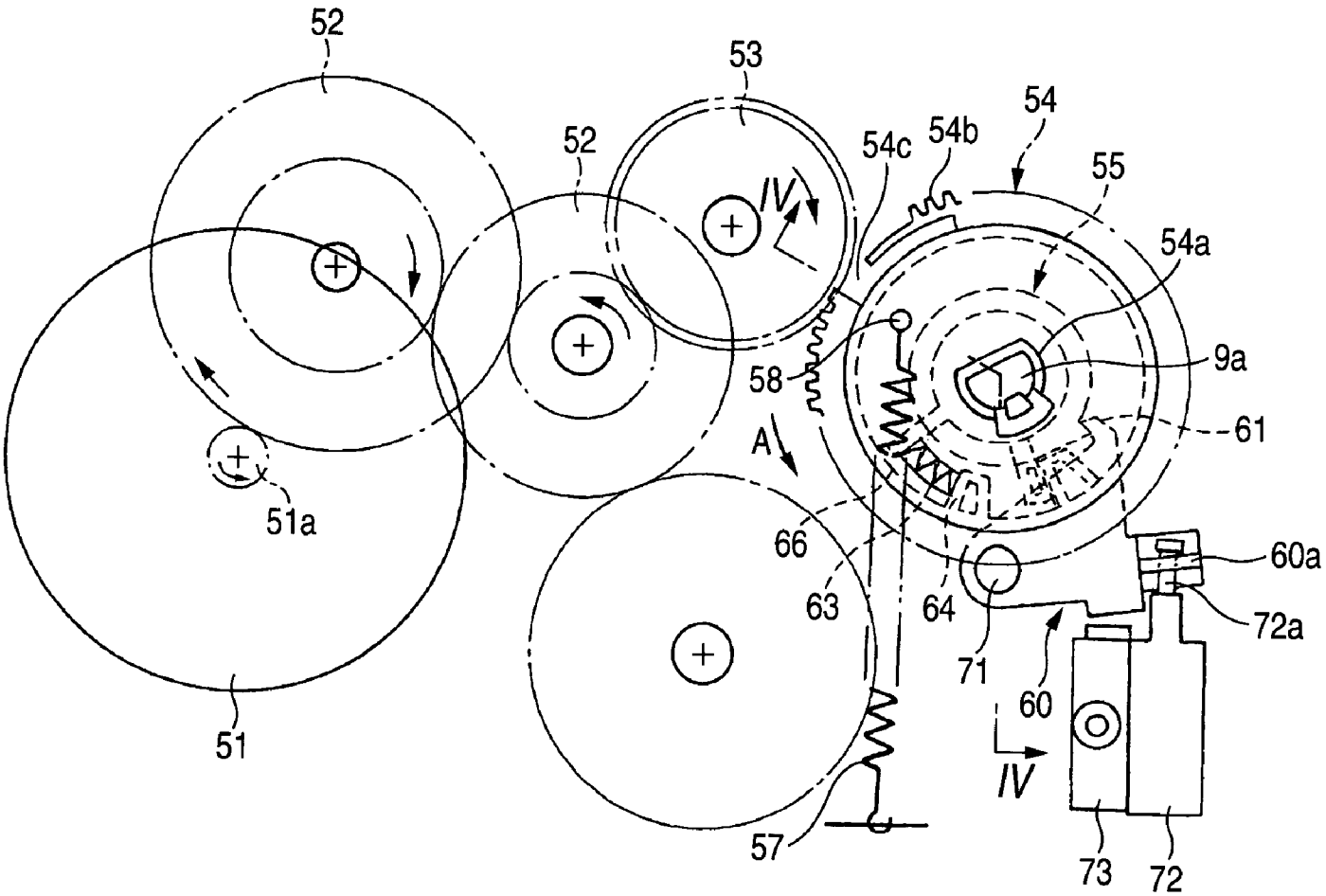
FIG. 2 is a front view of a motive power transmission system and a single-rotation clutch device in a sheet feeding section.
Figure 3:
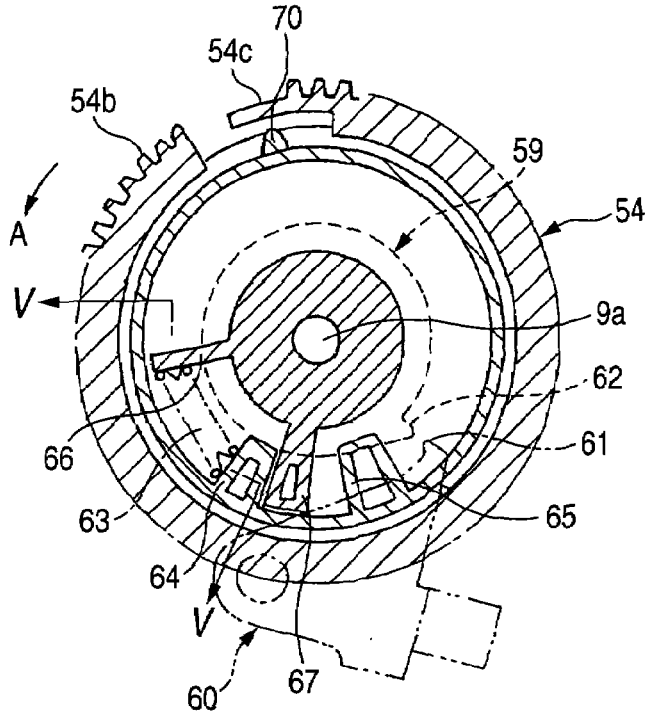
FIG. 3 is a front sectional view of the single-rotation clutch device in a state immediately after cancellation of engagement of an engagement lever.

Embodiments of the present invention will be hereinafter described. FIG. 1 is a schematic sectional view of a laser printer as an image forming apparatus according to an embodiment of the invention. FIG. 2 is a front view of a single-rotation clutch device that is used in a sheet feeder. FIG. 3 is a front view of the single-rotation clutch device in a state immediately after cancellation of engagement.

As shown in FIG. 1, a partition wall 2*a* is provided at a position closer to the bottom of a synthetic resin main body case 2 of a laser printer 1 so as to be integral with the main body case 2 and to partition the main body case 2 in the vertical direction. Control boards 14, 15, and 16 are disposed under the partition wall 2*a*, and their undersides are covered with a bottom cover body 50 formed of a metal sheet or the like. A sheet feeding section 4 for feeding a sheet (cut sheet) 3 as a recording medium is disposed under the bottom cover body 50. A process unit 18 as an image forming means for forming an image on a sheet 3 supplied, a scanner unit 17, a fuser 19 as a fusing means, etc. are provided above the partition wall 2*a*.

The sheet feeding section 4, which occupies a bottom portion of the main body case 2, is equipped with a sheet feed tray 6 that is mounted detachably, a sheet pushing plate 8 that is provided in the sheet feed tray 6, a generally D-shaped sheet feed roller 9 that is disposed over one end of the sheet feed tray 6, and a separation pad unit 10.

As shown in FIG. 1, a curved transport path 7 for a sheet 3 is formed from the sheet feed roller 9 to an image forming position (i.e., a contact position of a photoreceptor drum 23 and a transfer roller 25, that is, a transfer position where a toner image on the photoreceptor drum 23 is transferred to the sheet 3.). A transfer roller pair 11 and a registration roller pair 12 that is located immediately before the image forming position are disposed at a proper interval along the transfer path 7 downstream of the sheet feed roller 9.

The sheet pushing plate 8 allows stacking of sheets 3. The sheet pushing plate 8 is supported swingably at its end that is farther from the sheet feed roller 9, whereby its end closer to the sheet feed roller 9 can move vertically. The sheet pushing plate 8 is urged upward from below by a spring 8*a*. The sheet feed roller 9 and the separation pad unit 10 are opposed to each other, and a separation pad (not shown) that is a member having a large coefficient of friction is pressed against the sheet feed roller 9 by a spring 10*b* that is provided on the back side of a pad support body 10*c* of the separation pad unit 10.

The width dimensions, in the direction perpendicular to the transport direction of the sheet 3, of the separation pad and the sheet feed roller 9 are set smaller than the width dimension of the sheet 3. The separation pad and the sheet feed roller 9 are disposed so as to contact only approximately a central portion, in the width direction, of the sheet 3 being fed.

Top sheets 3 of the sheets 3 stacked on the sheet pushing plate 8 are pushed toward the sheet feed roller 9 and are sent out one by one by rotation of the sheet feed roller 9 while being parted from each other by the separation pad unit 10. A sheet 3 thus output from the sheet feeding section 4 is sent to the transport roller pair 11 and then to the registration roller pair 12. The sheet 3 is sent to the image forming position after its front edge is subjected to registration.

A manual feed tray 13 for a manual supply of a sheet 3 is provided in a foldable manner above the transport roller pair 11 (i.e., at a side portion of the main body case 2 above the sheet feeding section 4).

The scanner unit 17 is provided under the underside of a sheet ejection tray 36 so as to occupy a top portion of the main body case 2, and is equipped with a laser section (not shown), a polygon mirror 20 that is rotated, lenses 21*a* and 21*b*, reflectors 22, etc. A laser beam that is emitted from the laser section with prescribed timing on the basis of image data passes through or is reflected by the polygon mirror 20, lens 21*a* and 21*b*, and reflectors 22. The laser beam is scanned at high speed over the surface of the photoreceptor drum 23 as a photoreceptor (image carrier) of the process unit 18.

The process unit 18 includes a drum cartridge having the photoreceptor drum 23 as a photoreceptor, a scorotron charger 37 as a charging means, the transfer roller 25 as a transfer means, etc. and a development cartridge 24 that can be attached to and detached from the drum cartridge. The development cartridge 24 is equipped with a toner accommodation section 26, a development roller 27 as a developing means, a layer thickness limiting blade (not shown), a toner supply roller 29, etc.

The toner accommodation section 26 is provided with a positively chargeable, non-magnetic, single-component polymerized toner as a developer. The toner is supplied to the development roller 27 by means of the toner supply roller 29 and is charged positively by friction between the toner supply roller 29 and the development roller 27. The toner that has been supplied to the development roller 27 comes to be carried by the development roller 27 as a thin layer having a constant thickness by rubbing (sliding) with the layer thickness limiting blade as the development roller 27 rotates. The photoreceptor drum 23 that rotates is opposed to the development roller 27. The drum main body is grounded, and on its surface a positively chargeable photoreceptor layer made of an organic photoreceptor material such as polycarbonate is formed.

The scorotron charger 37 as a charging means is disposed over the photoreceptor drum 23 with a prescribed gap so as not to contact the latter. The scorotron charger 37 is a positive-charging scorotron charger that causes corona discharge from charging wires made of tungsten or the like and is configured so as to charge the surface of the photoreceptor drum 23 positively and uniformly.

As the photoreceptor drum 23 rotates, its surface is first charged positively and uniformly by the scorotron charger 37 and then subjected to a high-speed scan (i.e., exposure) with a laser beam emitted from the scanner unit 16, whereby an electrostatic latent image is formed on the basis of prescribed image data.

Then, as the photoreceptor drum 23 further rotates, positively charged toner is transferred from the development roller 27 to the photoreceptor drum 23 and comes to be carried selectively by the electrostatic latent image formed on the surface of the photoreceptor drum 23, that is, exposed portions, where the potential has been lowered by the exposure to the laser beam, of the surface of the photoreceptor drum 23 that was previously charged positively and uniformly. As a result, the image is visualized, that is, a toner image is formed.

The transfer roller 25 is disposed under the photoreceptor drum 23 and opposed to the latter. The transfer roller 25 is configured in such a manner that a metal roller shaft is covered with a roller made of an ion-conductive rubber material. During a transfer operation, a transfer bias (transfer forward bias) is applied to the transfer roller 25 from a transfer bias application power source. Therefore, a toner image carried by the surface of the photoreceptor drum 23 is transferred to a sheet 3 as the sheet 3 passes between the photoreceptor drum 23 and the transfer roller 25.

Next, the configuration of the fuser 19 as a fusing means will be described. As shown in FIG. 1, the fuser 19 is disposed beside and downstream of the process unit 18, and is equipped with a single heating roller 30, a pressing roller 31 that is disposed so as to be pressed against the heating roller 30, and a pair of transport rollers 32 that are disposed downstream of the heating roller 30 and the pressing roller 31. The heating roller 30 is made of a metal such as aluminum and equipped with a heater such as a halogen lamp for heating. The heating roller 30 thermally fuses toner that has been transferred onto a sheet 3 in the process unit 18 as the sheet 3 passes between the heating roller 30 and the pressing roller 31. Subsequently, the sheet 3 is transported by the transport rollers 32 to sheet ejection rollers 35 along a sheet ejection path that is located in one side portion of the main body case 2. The sheet 3 is then ejected to the sheet ejection tray 36.

In this embodiment, a sheet re-transport section 40 is provided to form an image on both surfaces of a sheet 3. As a reversing mechanism in the re-transport section 40, the sheet ejection rollers 35 can be rotated selectively in the normal direction or the reverse direction.

To perform double-sided printing, a sheet 3 bearing an image on its one surface that has been transported to the sheet ejection rollers 35 by the transport rollers 32 is stopped with its rear end portion held between the sheet ejection rollers 35. Then, the sheet ejection rollers 35 are rotated in the reverse direction, whereby the sheet 3 is sent to a reversing path 41 that is located in a side portion of the main body case 2.

Then, the sheet 3 is transported by oblique transport rollers 43 provided on a re-transport tray 42 that is disposed under the underside of the bottom cover body 50 and detachably attached to the top surface of the sheet feed tray 6 while a side edge of the sheet 3 is kept in contact with a reference plate (not shown). As a result, the sheet 3 is returned to another transport means 45 being guided by a re-transport guide plate 44. When the sheet 3 has reached the registration roller pair 12, the sheet 3 is reversed so that its unprinted surface is up. The sheet 3 passes the image forming position with such orientation, whereby an image can be formed on its original back surface.

Next, the configuration of a single-rotation clutch device provided in the sheet feed section 4 will be described with reference to FIGS. 2–7B. Drive force is transmitted from a pinion gear 51*a* of a drive motor 51 that is disposed close to one side wall of the main body case 2 to a drive gear 53 of a gear transmission system (gear train) 52, whereby the drive gear 53 is rotated clockwise in FIG. 2. One end portion of a transmission shaft 9*a* that rotates together with the sheet feed roller 9 is fitted in a D-shaped hole of a boss 54*a* of a tooth-partially-lacking gear 54, whereby the sheet feed roller 9 and the tooth-partially-lacking gear 54 are fixed to each other so as to rotate together. The tooth-partially-lacking gear 54 has, along its outer circumference, a tooth portion 54*b* that meshes with the teeth of the drive gear 53 and a non-tooth portion 54*c* that lacks teeth. The drive gear 53 is disposed so as to mesh with the tooth-partially-lacking gear 54 (see FIG. 2).

A cam body 55 that is opposed to one side surface (a front surface) of the tooth-partially-lacking gear 54 is rotatably mounted on (fitted with) the boss 54*a* which is fitted with the transmission shaft 9*a*. The boss 54*a* is provided with a coming-off preventive nail 56 that prevents the cam body 55 from coming off the tooth-partially-lacking gear 54 along the axial line of the transmission shaft 9*a* (see FIG. 4).

Figure 6A:
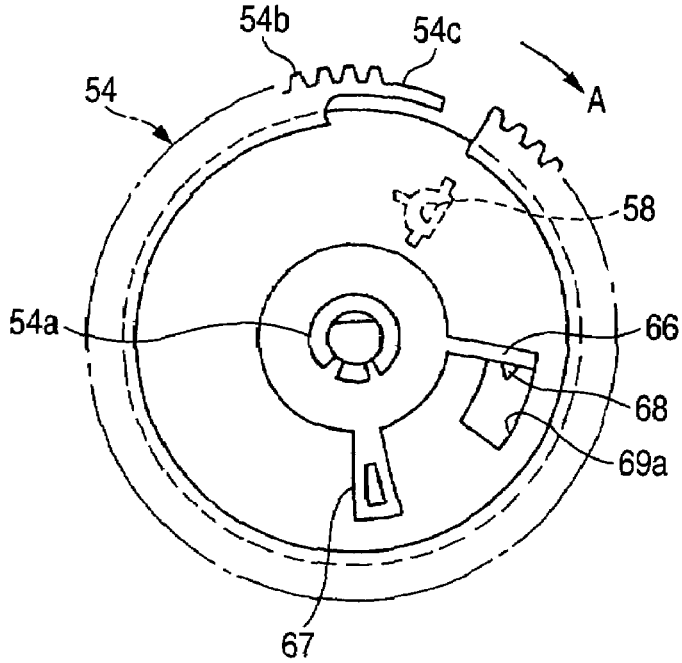
FIG. 6A is a rear view of a tooth-partially-lacking gear.
Figure 6B:
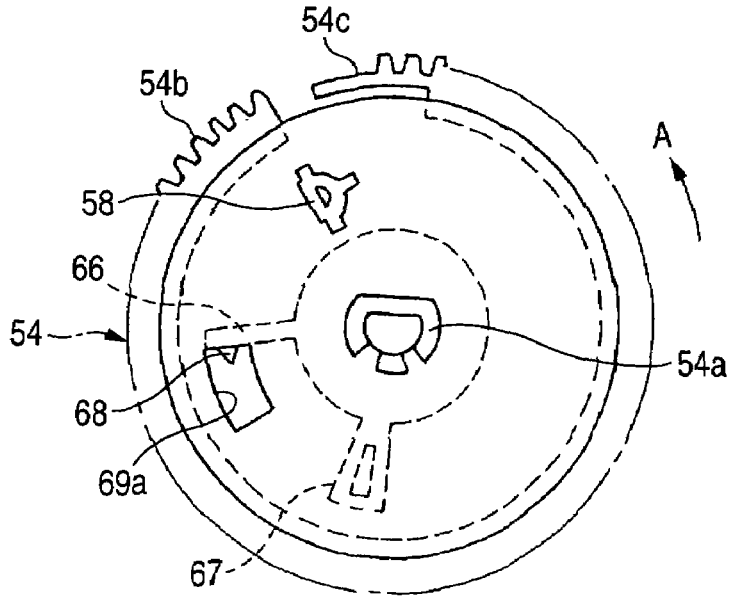
FIG. 6B is a front view of the tooth-partially-lacking gear.

FIGS. 6A and 6B show the rear surface and the front surface (i.e., the surface facing the cam body 55) of the tooth-partially-lacking gear 54 respectively. A pin 58 to which one end of an urging spring 57 is to be connected is provided on the front surface of the tooth-partially-lacking gear 54 (see FIGS. 4 and 6A). The other end of the urging spring 57 is hooked on a hooking portion of a frame or the like (not shown).

Figure 4:
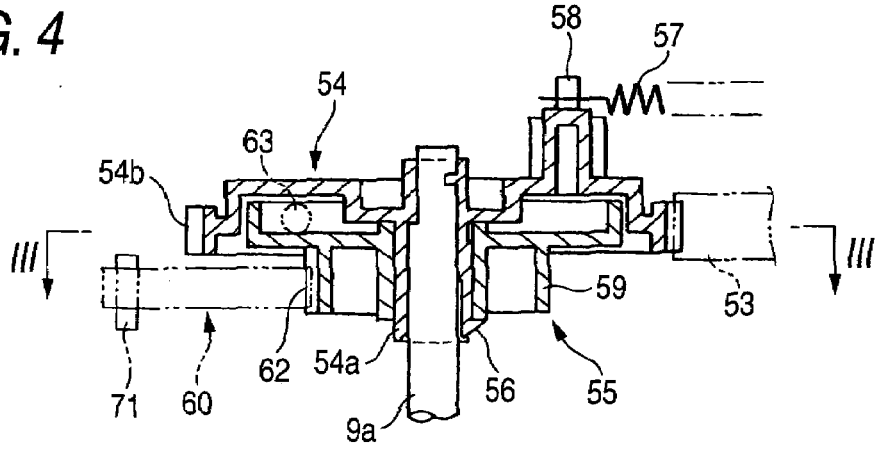
FIG. 4 is an enlarged sectional view taken along line IV—IV in FIG. 2.
Figure 5:
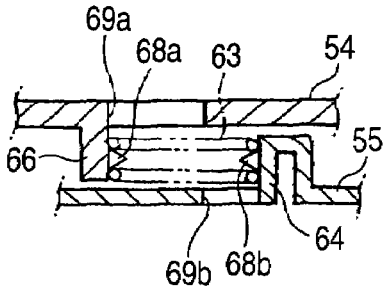
FIG. 5 is an enlarged sectional view taken along line V—V in FIG. 3.
Figure 7A:
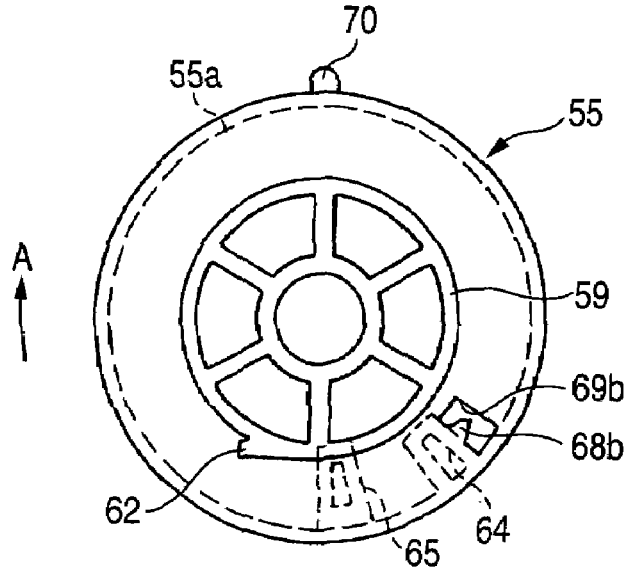
FIG. 7A is a rear view of a cam body.
Figure 7B:
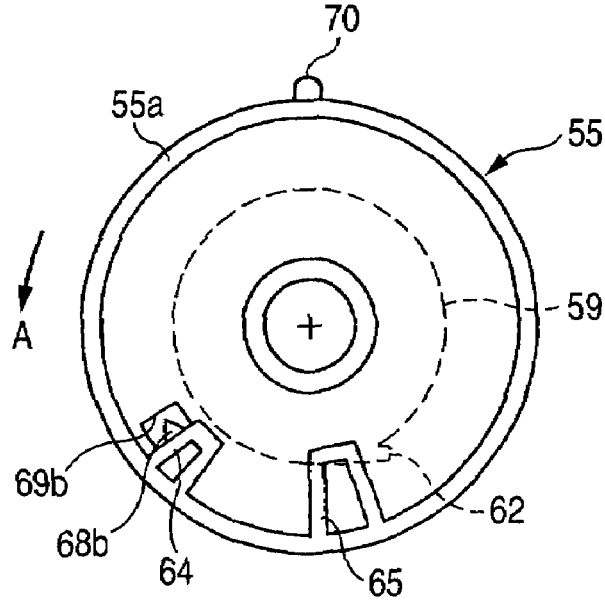
FIG. 7B is front view of the cam body.

On the other hand, a cam portion 59 having a small outer diameter is formed integrally with the side surface (a front surface) of the cam body 55 that is opposite to the surface facing the tooth-partially-lacking gear 54. The outer circumferential surface of the cam portion 59 is formed, at one position, with an engagement step 62 that is to engage with an engagement nail 61 of an engagement lever 60 (described later) as shown in FIGS. 4 and 7A.

An elastic body 63 for elastically transmitting rotation force from the tooth-partially-lacking gear 54 to the cam body 55 is inserted between the confronting surfaces of the cam body 55 and the tooth-partially-lacking gear 54 so as not to fall off. Where the elastic body 63 is a compression coil spring (see FIGS. 2–5), supporting means for supporting the elastic body 63 are provided on the confronting surfaces of the cam body 55 and the tooth-partially-lacking gear 54. More specifically, a highly rigid first support portion 64 that is generally trapezoidal, for example, in a side view is formed integrally with the cam body 55 so as to extend inward in the radial direction from an outer circumferential rim of the cam body 55 (see FIGS. 7A and 7B). A second support portion 66 is formed, upstream of the first support portion 64 of the cam body 55 in the rotation direction, integrally with the confronting surface of the tooth-partially-lacking gear 54 so as to extend outward in the radial direction from the boss 54*a*. (See FIGS. 6A and 6B). A first restricting piece 65 is formed, downstream of the first support portion 64 in the rotation direction (indicated by arrow A), integrally with the cam body 55 so as to extend in the radial direction from the outer circumferential rim 55*a*. (See FIGS. 7A and 7B.)

A second restricting piece 67 is formed, downstream of the second support portion 66 in the rotation direction (indicated by arrow A), integrally with the confronting surface of the tooth-partially-lacking gear 54 so as to extend outward in the radial direction from the boss 54*a*. (See FIGS. 6A and 6B.) The first restricting piece 65 and the second restricting piece 67 serve to maintain a state that the sheet feed roller 9 is stopped at a position having a prescribed rotation phase. After the engagement nail 61 of the engagement lever 60 has engaged with the engagement step 62 of the cam body 55 to stop rotation of the cam body 55, the first restricting piece 65 and the second restricting piece 67 contact each other at a phase which causes the tooth-partially-lacking gear 54 to stop. As a result, the tooth-partially-lacking gear 54 stops together with the transmission shaft 9*a* at such a position that a smaller-radius portion of the D-shaped sheet feed roller 9 that is fixed to the transmission shaft 9*a* faces a sheet 3 to be sent out.

Projection-shaped supporting/restricting units 68*a* and 68*b* for preventing deviation of the elastic body (coil spring) 63 at the support positions at both ends are provided on the confronting surfaces of the second support portion 66 and the first support portion 64, respectively. Windows 69*a* and 69*b* are formed in the plate portions of the tooth-partially-lacking gear 54 and the cam body 55, respectively. The windows 69*a* and 69*b* make it possible to adjust and check the setting state of the elastic body (coil spring) 63 after the cam body 55 has been attached to the tooth-partially-lacking gear 54 so as not to fall off and the elastic body 63 has been inserted between the first support portion 64 and the second support portion 66. (See FIGS. 6A, 6B, 7A, and 7B.) Further, a projection 70 as a positioning mark projects outward in the radial direction from the outer circumferential rim 55*a* of the cam body 55. If the cam body 55 is attached to the tooth-partially-lacking gear 54 with the mark projection 70 aligned with the non-tooth portion 54*c* of the tooth-partially-lacking gear 54, the phases of the non-tooth portion 54*c* and the cam body 55 can be set to such regular values that the second restricting piece 67 of the tooth-partially-lacking gear 54 is located between the first support portion 64 and the first restricting piece 65. If each of the tooth-partially-lacking gear 54 and the cam body 55 is formed by injection-molding a synthetic resin material, respective portions of the tooth-partially-lacking gear 54 and the cam body 55 can be formed integrally with each other, which leads to cost reduction.

The engagement lever 60 having the engagement nail 61 to be engaged with and disengaged from the engagement step 62 of the cam body 55 is rotatably attached to a horizontal shaft 71 that is provided on a frame or the like (not shown). One end portion 60*a* of the engagement lever 60 is connected to an operating portion 72*a* of a solenoid 72 as an actuator that is fixed to a holder 73 that is provided on the frame or the like (see FIGS. 2 and 3). In an unenergized state, the solenoid 72 is urged by an urging means (spring) provided inside the solenoid 72 in such a direction that the engagement nail 61*of* the engagement lever 60 comes closer to the outer circumference of the cam portion 59 of the cam body 55. When the solenoid 72 is energized, the engagement lever 60 is rotated against the urging force of the urging means in such a direction that the engagement nail 61 goes away from the outer circumference of the cam portion 59 of the cam body 55.

Next, the operation of the single-rotation clutch device having the above configuration will be described. FIG. 2 shows a state that a sheet feeding operation is not being performed. The pinion gear 51*a* of the drive motor 51 is rotated counterclockwise in FIG. 2, and the drive gear 53 is rotated clockwise by the gear transmission system 52. In this state, in the process unit 18, the photoreceptor drum 23, etc., and the toner supply roller 27, etc., of the development cartridge 24 are being rotated. Since the solenoid 72 as an actuator is in an unenergized state, the engagement nail 61 of the engagement lever 60 is engaged with the engagement step 62 of the cam body 55 and hence rotation of the cam body 55 is prevented. The elastic body 63 is inserted between the first support portion 64 and the second support portion 66 and interposed between the cam body 55 and the tooth-partially-lacking gear 54. Further, since the urging force of the urging spring 57 gives the tooth-partially-lacking gear 54 the moment of urging the tooth-partially-lacking gear 54 counterclockwise in FIG. 2, the second support portion 66 exerts pressing force on the elastic body 63 in the direction of arrow A. The elastic body 63 is contracted by the pressing force, and hence the second restricting piece 67 of the tooth-partially-lacking gear 54 is brought into contact, from the upstream side of the rotation, with the first restricting piece 65 of the cam body 55 whose rotation is prevented by the engagement lever 60, whereby the tooth-partially-lacking gear 54 is positioned. A state (non-mesh state) that the non-tooth portion 54*c* of the tooth-partially-lacking gear 54 is opposed to the drive gear 53 is maintained.

The tooth-partially-lacking gear 54 is kept stopped at the phase of FIG. 2 and the sheet feed roller 9 is not rotated though the tooth-partially-lacking gear 54 is being given the moment by the urging spring 57.

When a voltage is applied temporarily to the solenoid 72 in response to a sheet feed signal, the operating portion 72*a* operates and hence the engagement lever 60 is rotated clockwise in FIG. 2. As a result, the engagement nail 61 is disengaged from the engagement step 62 of the cam body 55 to render the cam body 55 rotatable about the transmission shaft 9*a*. FIG. 3 shows this state. Immediately before the tooth portion 54*b* of the tooth-partially-lacking gear 54 starts to engage with the drive gear 53, the tooth-partially-lacking gear 54 pushes the elastic body 63 in the direction of arrow A via the second support section 66 because the urging force of the urging spring 57 in the direction of arrow A gives the tooth-partially-lacking gear 54 external force of rotating the tooth-partially-lacking gear 54 in the direction of arrow A. On the other hand, since the engagement state that is established by the engagement lever 60 is canceled abruptly to render the cam body 55 in a free rotation state, the elastic body (coil spring) 63 expands and hence the first support portion 64 goes away from the second support portion 66 and approaches the back face of the second restricting piece 67 (see FIG. 3). Since the solenoid 72 was de-energized in the above period, the engagement lever 60 is returned to the original position so that the engagement nail 61 contacts the outer circumferential surface of the cam portion 61.

Then, after the tooth portion 54*b* of the tooth-partially-lacking gear 54 has meshed with the drive gear 53, the elastic body 63 is kept expanded while the tooth-partially-lacking gear 54 makes approximately one rotation in the direction of arrow A to a phase at which the drive force of the drive gear 53 causes the non-tooth portion 54*c* to come close to the drive gear 53 (i.e., until an instant when the engagement nail 61 touches the engagement step 62). After the engagement nail 61 has touched the engagement step 62, only the tooth-partially-lacking gear 54 rotates in the direction of arrow A as described above while the cam body 55 is stopped and hence the second support portion 66 approaches the first support portion 64. That is, the elastic body 63 (coil spring) is contracted. As described above, when the engagement nail 61 of the engagement lever 60 touches the engagement step 62, the forcible drive force of the tooth-partially-lacking gear 54 does not directly act on the cam body but is transmitted to the cam body 55 in such a manner that the elastic body 63 pushes the first support portion 64 while being contracted. Therefore, the impact between the engagement nail 61 and the engagement step 62 is reduced as energy is consumed for the contraction of the elastic body 63. In other words, first the engagement nail 61 gently touches the engagement step 62. As the pushing force of the elastic body 63 increases gradually, the engagement nail 61 pushes the engagement step 62 while the rotation speed of the tooth-partially-lacking gear 54 is decreased gradually. The engagement between the engagement nail 61 and the engagement step 62 is maintained. Therefore, an impact sound that occurs when the cam body 55 and the tooth-partially-lacking gear 54 stop after making one rotation is very small. In contrast, in the conventional case in which the cam body and the tooth-partially-lacking gear constitute an integral member, a strong impact occurs instantaneously between the engagement nail 61 and the engagement step 62 when they engage with each other, to generate a large impact sound.

If the initial length of the coil-spring-shaped elastic body 63 (i.e., the length of the elastic body 63 in a state that the engagement nail 61 is not engaged with the engagement step 62) is too long, the elastic body 63 is contracted by a great length after the engagement nail 61 touches the engagement step 62, to raise the following problem. At the final stage of the contraction, repulsive force generated by the contraction of the elastic body 63 acts on the tooth-partially-lacking gear 54 in the direction opposite to the direction of arrow A. This reaction force counteracts the urging force of the urging spring 57 for urging the tooth-partially-lacking gear 54 so that the non-tooth portion 54*c* reaches the position opposed to the drive gear 53. In other words, the reaction force counteracts the rotation moment for moving the tooth-partially-lacking gear 54 to the stop phase. According to this embodiment, for example, the initial length of a compression-coil-spring-shaped elastic body 63 that had a coil diameter of about 4 mm is set to about 15 mm, and the elastic body 63 is connected to the tooth-partially-lacking gear 54 at a position having a distance of about 20 mm from the axial line of the transmission shaft 9*a* in the radial direction. In this case, the impact sound is reduced by about 6 dB (about 50%).

Figure 8:
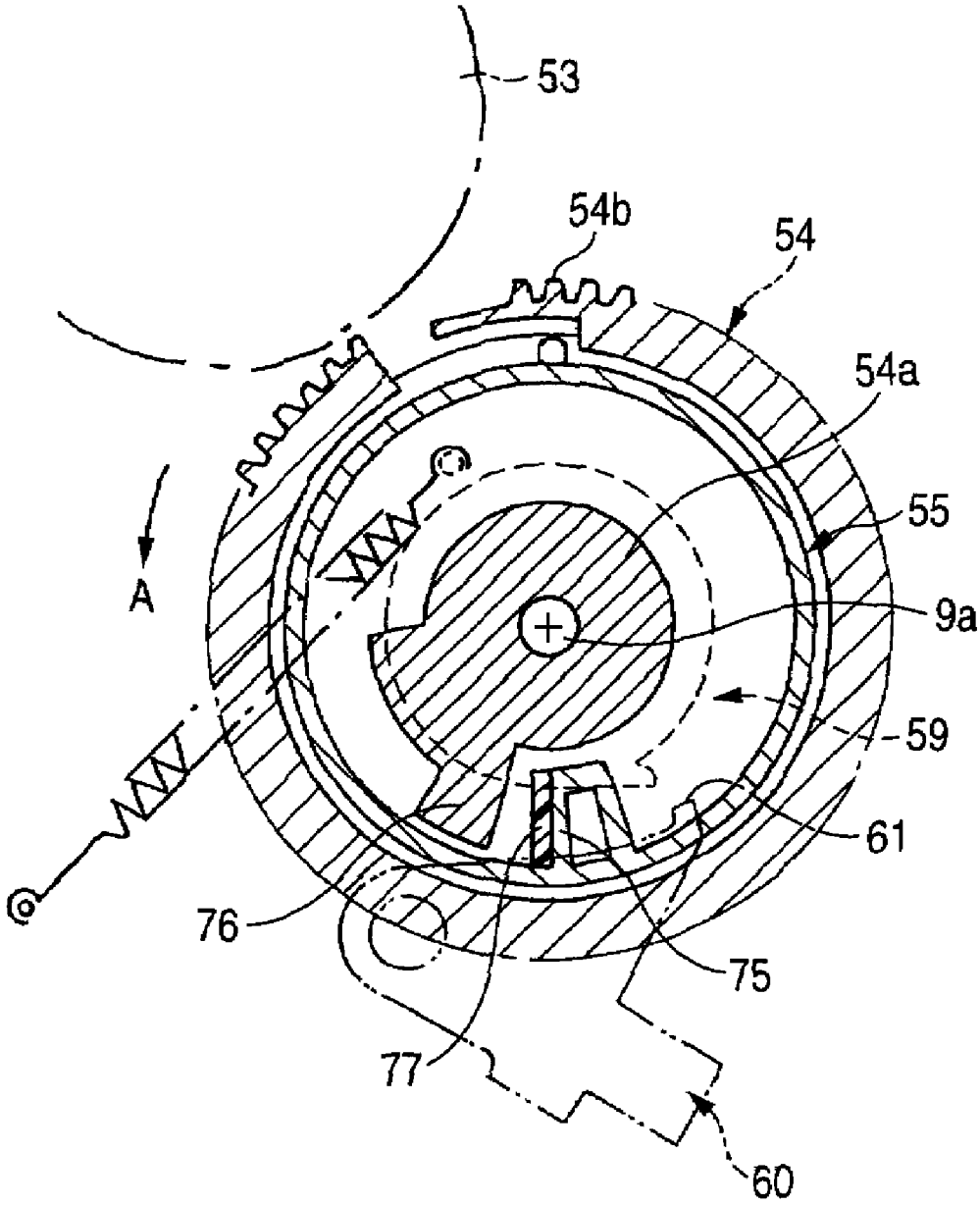
FIG. 8 is a front view of a single-rotation clutch device according to a second embodiment of the invention.

FIG. 8 shows a single-rotation clutch device according to a second embodiment of the invention. A first contact portion 75 is provided integrally with the side surface of the cam body 55 that is opposed to the tooth-partially-lacking gear 54. On the other hand, a second contact portion 76 is provided, upstream of the first contact portion 75 in the rotation direction, integrally with the side surface of the tooth-partially-lacking gear 54 that is opposed to the cam body 55. A flat elastic body 77 such as a plate-like sponge rubber member or a semirigid synthetic rubber plate is fixed to the first contact portion 75. In this embodiment, the flat elastic body 77 is fixed to the upstream (in the rotation direction indicated by arrow A) back face of the first contact portion 75 (e.g., the former is stuck to the latter with an adhesive or the like). The elastic body 77 is likewise long in the radial direction. Incidentally, the elastic body 77 may be provided on the second contact portion 76, or on both of the first and second contact portions 75 and 76.

The first contact portion 75 is formed integrally with the outer circumferential rim 55*a* of the cam body 55 so as to extend from the latter inward in the radial direction (see FIG. 8). The second contact portion 76 is formed, upstream of the first contact portion 75 of the cam body 55 in the rotation direction, integrally with the side surface of the tooth-partially-lacking gear 54 that is opposed to the cam body 55 so as to extend outward in the radial direction from the boss 54*a* (see FIG. 8). In this embodiment, the first contact portion 75 also has the function of the first restricting piece and the second contact portion 76 also has the function of the second restricting piece 67.

The other part of the configuration of the clutch device according to the second embodiment is approximately the same as the corresponding part of the configuration of the clutch device according to the first embodiment. Members having corresponding members in the first embodiment are given the same reference symbols as the latter and will not be described in detail. In the second embodiment, when the engagement lever 60 has operated and the engagement nail 61 has been disengaged from the engagement step 62, the cam body 55 is rendered rotatable about the transmission shaft 9*a*. Immediately before the tooth portion 54*b* of the tooth-partially-lacking gear 54 starts to mesh with the drive gear 53, the second contact portion 76 pushes the elastic body 77 in the direction of arrow A with the elastic body 77 kept sandwiched between the first contact portion 75 and the second contact portion 76 because the urging force of the urging spring 57 in the direction of arrow A gives the tooth-partially-lacking gear 54 external force for rotation in the direction of arrow A. The cam body 55 is also rotated in the direction of arrow A.

When the engagement nail 61 again touches the engagement step 62 after the cam body 55 and the tooth-partially-lacking gear 54 have made approximately one rotation with the engagement nail 61 kept in sliding contact with the outer circumferential surface of the cam portion 59, the cam body 55 is stopped. Also, when a non-driving state is established in which the non-tooth portion 54*c* of the tooth-partially-lacking gear 54 is opposed to the drive gear 53, the rotation moment generated by the urging spring 57 acts on the tooth-partially-lacking gear 54 and only the tooth-partially-lacking gear 54 is rotated in the direction of arrow A as described above while the cam body 55 is stopped. Therefore, the elastic body 77 provided on the back face of the first contact portion 75 (i.e., on the upstream side in the rotation direction) is contracted. In this manner, the second contact portion 76 gradually approaches the back face of the first contact portion 75 and then stops. As described above, in the second embodiment, when the cam body 55 is stopped forcibly by the engagement lever 60, the flat elastic member 77 is contracted. Therefore, when the engagement nail 61 of the engagement lever 60 touches the engagement step 62, the forcible drive force of the tooth-partially-lacking gear 54 does not directly act on the cam body 55 but is transmitted to the first contact portion 75 and hence to the cam body 55 while the elastic body 77 is contracted. Therefore, the impact between the engagement nail 61 and the engagement step 62 is reduced by energy that is consumed for the contraction of the elastic body 77. The impact sound of impact between the engagement nail 61 and the engagement step 62 can thus be made very small as in the first embodiment. The elastic body may be provided on either one or both of the first contact portion 75 and the second contact portion 76.

In the second embodiment, the elastic member 77 may be a flat member that is thin in the rotation direction of the tooth-partially-lacking gear 54 (cam body 55) and long in its radial direction. Since the only force acting on the elastic member 77 is force in the rotation direction (i.e., circumferential direction) of the tooth-partially-lacking gear 54 (cam body 55), no shearing force, frictional force, or bending force acts on the elastic member 77 even if the elastic member 77 is fixed to the first contact portion 75 with an adhesive or the like. There does not occur such trouble as peeling of the elastic body 77 from the first contact portion 75; the durability is increased. The stop phase of the sheet feed roller 9 can be allowed to fall within a predetermined range while the impact sound is made small by using, for the elastic body 77, a material that provides a certain compression deformation amount while setting the thickness of the elastic body 77 small.

Where the single-rotation clutch device according to the invention is applied to a sheet feeder, impact sounds that occur intermittently when sheets 3 are sent out one by one can be made small. Also in an image forming apparatus that is equipped with such a sheet feeder, sounds that occur during sheet feeding operations can be made small, that is, a silent apparatus can be provided.

In the invention, a torsion spring or the like may be used instead of the elastic body 63 (or 77). The rotary clutch device according to the invention may be configured so as to stop once for a plurality of rotations, and its application range is not limited to sheet feeders but covers other kinds of apparatuses.

As described above, according to the invention, the rotary clutch device includes a tooth-partially-lacking gear that can mesh with a drive gear and is given initial rotation force and a rotatable cam body that is concentric with the tooth-partially-lacking gear. An engagement lever is disengaged from an engagement step of the cam body and the tooth-partially-lacking gear starts to rotate due to an intermittent operation of an actuator. Rotation of the tooth-partially-lacking gear is stopped when the engagement lever engages with the cam body. Rotation force of the tooth-partially-lacking gear is transmitted to the cam body via an elastic body.

When the cam body is stopped, the rotation force of the tooth-partially-lacking gear is transmitted to the cam body via the elastic body that is contracted. This provides an advantage that the engagement step of the cam body and the engagement nail of the engagement lever do not receive much impact and hence the impact sound can be made very small.

According to the invention, a first support portion and a second support portion are provided on confronting side surfaces of the cam body and the tooth-partially-lacking gear, respectively, so as to be opposed to each other in a rotation direction. Both ends of the elastic body are supported between the first support portion and the second support portion.

The pressing force of the tooth-partially-lacking gear can easily be transmitted to the cam body because both ends of the elastic body are supported between the first support portion and the second support portion originally.

According to the invention, a first contact portion and a second contact portion are provided on confronting side surfaces of the cam body and the tooth-partially-lacking gear, respectively, so as to be opposed to each other in a rotation direction, and that a flat elastic body is fixed to one or both of the first contact portion and the second contact portion. Since the elastic body is flat as described above, this configuration provides an advantage that the single-rotation clutch device can be made compact by decreasing the interval between the first contact portion and the second contact portion. This configuration also provides an advantage that when the rotation force of the tooth-partially-lacking gear is transmitted to the cam body, the contact portions are prevented from generating an impact sound because the second contact portion does not directly touch the first contact portion.

According to the invention, the first and second contact portions are formed so as to be long in a radial direction of the cam body and the tooth-partially-lacking gear, and the elastic body is provided on confronting faces of the two contact portions. This configuration provides, in addition to the functions and advantages that the contact area can be made relatively large and the strength of the fixing of the elastic bodies to the respective contact portions can be increased even if the elastic bodies are thin.

The sheet feeder according to the invention includes a sheet stacking unit in which sheets are stacked; and a sheet feed roller for sending out a sheet that is supplied from the sheet stacking unit, the sheet feed roller being driven by the drive gear via the rotary clutch device. This configuration makes it possible to reduce a sound that is generated by the rotary clutch device when a sheet is fed, to thereby provide a silent sheet feeder.

The image forming apparatus according to the invention includes the sheet feeder, and an image forming unit for forming an image on a sheet that is fed from the sheet feeder. This configuration provides an advantage that a silent image forming apparatus can be provided in which a sound that is generated by the sheet feeder in a sheet feed operation.

What is claimed is:

1. A rotary clutch device, comprising:

a tooth-partially-lacking gear that can mesh with a drive gear and is given initial rotation force;

a rotatable cam body that is concentric with the tooth-partially-lacking gear, having an engagement step, the rotatable cam body separated from the drive gear in a radial direction so as to form a space therebetween; and an elastic body;

wherein an engagement lever is engaged with and disengaged from the engagement step according to an intermittent operation of an actuator so that the tooth-partially-lacking gear starts and stops to rotate; and rotation force of the tooth-partially-lacking gear is transmitted to the cam body via the elastic body.

2. The rotary clutch device according to claim 1, wherein the cam body includes a first support portion;

the tooth-partially-lacking gear includes a second support portion;

the first support portion and the second support portion are provided on confronting side surfaces of the cam body and the tooth-partially-lacking gear, respectively, so as to be opposed to each other in a rotation direction; and both ends of the elastic body are supported by the first support portion and the second support portion.

3. The rotary clutch device according to claim 1, wherein the cam body includes a first contact portion;

the tooth-partially-lacking gear includes a second contact portion;

the first contact portion and the second contact portion are provided on confronting side surfaces of the cam body and the tooth-partially-lacking gear, respectively, so as to be opposed to each other in a rotation direction; and a flat elastic body is fixed to at least one of the first contact portion and the second contact portion.

4. The rotary clutch device according to claim 3, wherein the first and second contact portions are formed so as to be long in the radial direction of the cam body and the tooth-partially-lacking gear; and the elastic body is provided on at least one of confronting faces of the first and second contact portions.

5. A sheet feeder, comprising:

a sheet stacking unit in which sheets are stacked;

a sheet feed roller that sends out a sheet supplied from the sheet stacking unit; and a rotary clutch device;

wherein the sheet feed roller is driven by a drive gear via the rotary clutch device;

the rotary clutch device includes: a tooth-partially-lacking gear that can mesh with the drive gear and is given initial rotation force, a rotatable cam body that is concentric with the tooth-partially-lacking gear, having an engagement step, an engagement lever and an elastic body, the rotatable cam body separated from the drive gear in a radial direction so as to form a space therebetween;

the engagement lever is engaged with and disengaged from the engagement step according to an intermittent operation of an actuator so that the tooth-partially-lacking gear starts and stops to rotate; and rotation force of the tooth-partially-lacking gear is transmitted to the cam body via the elastic body.

6. An image forming apparatus, comprising:

a sheet stacking unit in which sheets are stacked;

a sheet feed roller that sends out a sheet supplied from the sheet stacking unit;

an image forming unit that forms an image on a sheet that is sent by the sheet feed roller; and a rotary clutch device;

wherein the sheet feed roller is driven by a drive gear via the rotary clutch device;

the rotary clutch device includes: a tooth-partially-lacking gear that can mesh with the drive gear and is given initial rotation force, a rotatable cam body that is concentric with the tooth-partially-lacking gear, having an engagement step, an engagement lever and an elastic body, the rotatable cam body separated from the drive gear in a radial direction so as to form a space therebetween;

the engagement lever is engaged with and disengaged from the engagement step according to an intermittent operation of an actuator so that the tooth-partially-lacking gear starts and stops to rotate; and rotation force of the tooth-partially-lacking gear is transmitted to the cam body via the elastic body.

7. A rotary clutch device, comprising:

a first rotating body with which a rotating force is supplied by a driving source;

a second rotating body disposed concentrically with the first rotating body, the second rotating body with which the rotating force is supplied by the first rotating body;

an engagement portion being engageable with the second rotating body to restrict rotation thereof; and an elastic body disposed between the first rotating body and the second rotating body to transmit the rotating force from the first rotating body to the second rotating body;

wherein the second rotating body is smaller in diameter than the first rotating body; and wherein the elastic body is compressed when the engagement portion restricts the rotation of the second rotating body.

8. A rotary clutch device, comprising:

a first rotating body with which a rotating force is supplied from a driving source;

a second rotating body with which the rotating force is supplied by the first rotating body;

an engagement portion being engageable with the second rotating body to restrict rotation thereof periodically; and an impact absorber disposed between the first rotating body and the second rotating body to absorb an impact that occurs when the engagement portion is engaged with the second rotating body.

* * * * *